US007175110B2

(12) United States Patent
Vicentini

(10) Patent No.: US 7,175,110 B2
(45) Date of Patent: Feb. 13, 2007

(54) MANUAL SPRAY GUN AND ASSOCIATED DISPOSABLE CUP

(75) Inventor: Marco G. Vicentini, Turin (IT)

(73) Assignee: Anest Iwata Corporation (JP)

( * ) Notice: Subject to any disclaimer, the term of this patent is extended or adjusted under 35 U.S.C. 154(b) by 223 days.

(21) Appl. No.: 11/019,595

(22) Filed: Dec. 21, 2004

(65) Prior Publication Data

US 2006/0131446 A1 Jun. 22, 2006

(51) Int. Cl.

| | |
|---|---|
| ***B05B 7/02*** | (2006.01) |
| ***B05B 9/01*** | (2006.01) |
| ***A62C 13/62*** | (2006.01) |
| ***A62C 31/02*** | (2006.01) |

(52) U.S. Cl. ..... 239/526; 239/525; 239/302; 239/390; 239/397; 239/328; 239/394

(58) Field of Classification Search ..... 239/526, 239/525, 302, 390, 397, 328, 394; 222/105, 222/183, 541.1, 482

See application file for complete search history.

(56) References Cited

U.S. PATENT DOCUMENTS

| | | | | |
|---|---|---|---|---|
| 5,816,501 | A * | 10/1998 | LoPresti et al. | 239/302 |
| 6,595,441 | B2 * | 7/2003 | Petrie et al. | 239/345 |
| 6,796,514 | B1 * | 9/2004 | Schwartz | 239/345 |
| 6,820,824 | B1 * | 11/2004 | Joseph et al. | 239/346 |
| 6,938,836 | B2 * | 9/2005 | Bouic | 239/346 |

FOREIGN PATENT DOCUMENTS

| | | |
|---|---|---|
| FR | 2 798 868 | 3/2001 |
| WO | WO 03/045575 A1 | 6/2003 |

* cited by examiner

*Primary Examiner*—Davis Hwu
(74) *Attorney, Agent, or Firm*—Ostrolenk, Faber, Gerb & Soffen, LLP

(57) ABSTRACT

A cup (6) for spray guns, comprising a disposable container (8) joined in removable fashion to a lid (5) with axial outflow fitting (7), independent of the cup and integrated with the body (4) of the gun (1), and a lining element (18) whose shape is complementary to that of the lid (5) and which is inserted in removable fashion within said lid (5) between the container (8) and the outflow fitting (7).

22 Claims, 3 Drawing Sheets

MANUAL SPRAY GUN AND ASSOCIATED DISPOSABLE CUP

FIELD OF THE INVENTION

The present invention relates to manual guns for the spray-on application of coating substance such as paints, chemical products and the like.

More specifically, the invention relates to a manual spray gun of the type comprising a body having a conduit for supplying a substance to be sprayed whereto can be connected a disposable cup having a separable lid provided with an outflow fitting for connection to said supply conduit.

PRIOR ART

Spray guns of this kind are known, for instance from the documents U.S. Pat. No. 6,213,410 and US-A2002/0134861. In such guns, the disposable cup is applied in upside down conditions over the gun, and the substance to be sprayed contained in the cup is fed by gravity to the atomising nozzle with which the gun is fitted.

Alternatively, the cup can be applied underneath the gun, and in this case the substance to be sprayed is supplied under pressure to the atomising nozzle of the gun.

When the substance is depleted, the disposable cup is removed, thrown away and replaced with a new cup.

Traditionally in the disposable cups of known spray guns the lid, which is normally separable, constitutes an integral part of the cup: this entails the need to provide a system for coupling with any adapters between the outflow fitting of the lid and the body of the gun which, in addition to being relatively expensive, at times leads to difficulties with the application and removal of the disposable cup.

A solution of this kind is, in particular, described in the document WO-98/32539, which discloses a cup within which is inserted a disposable container with the substance to be sprayed: said container can consist of a collapsible bag or, as in the cases described with reference to FIG. 2 and to FIG. 10 of said document, in a vase-shaped container. In both cases, it is an element that serves as an internal liner of the actual cup, which is constituted by an external container connected in removable fashion to a lid with generally conical shape having an axial outflow fitting which can be connected to the body of the spray gun by means of an adapter. This solution eliminates or at least reduces the need to wash the cup at the end of the spraying operations, but the removal of the internal liner element for its replacement requires the prior disassembly of the external container. The external container, too, can be disposable, but in this case the cost of the whole cup is high.

The current trend, in any case, is to construct the whole cup as a disposable element, so it can be removed and replaced more rapidly when the substance to be sprayed, present within it, is depleted. A solution of this kind is described in the aforementioned document WO-98/32539 with reference to FIGS. 15–18, and it consists of a disposable cup comprising a container open at an end and provided at the other end with an aeration hole able to be closed, and of a generally conical lid connected in removable fashion to the open end of the container, with the possible provision of a filter, and having an axial outflow fitting able to be connected to the body of a spray gun through an appropriate adapter. After use, both container and lid are thrown away and replaced. Alternatively, the lid may constitute a reusable component, i.e. one that can be used after use together with the gun.

The first solution (i.e. with disposable container and lid) is relatively costly due to the need to form the outflow fitting of the lid with the means for its removable connection to the gun or even to provide a specific adapter.

With the second solution (disposable container and reusable lid), when the disposable cup needs to be replaced with a similar disposable cup containing a different substance, it is necessary to wash the lid. This operation can be inconvenient and arduous, and it also entails the risk that, as a result of a hasty or incomplete, the previous substance may contaminate, at least in part, the new substance subsequently sprayed.

SUMMARY OF THE INVENTION

The object of the present invention is to overcome the aforesaid drawbacks, and said object is achieved thanks to the fact that, on one hand, the aforesaid lid is independent of the cup and constitutes a part of the body of the gun, an on the other hand the container of the disposable cup further comprises a lining element having complementary shape to that of said lid and positioned in removable fashion within the lid between said open end of the container and said outflow fitting.

BRIEF DESCRIPTION OF THE DRAWINGS

The invention shall now be described in detail with reference to the accompanying drawings, provided purely by way of non limiting example, in which.

DETAILED DESCRIPTION OF THE INVENTION

Figure 1:
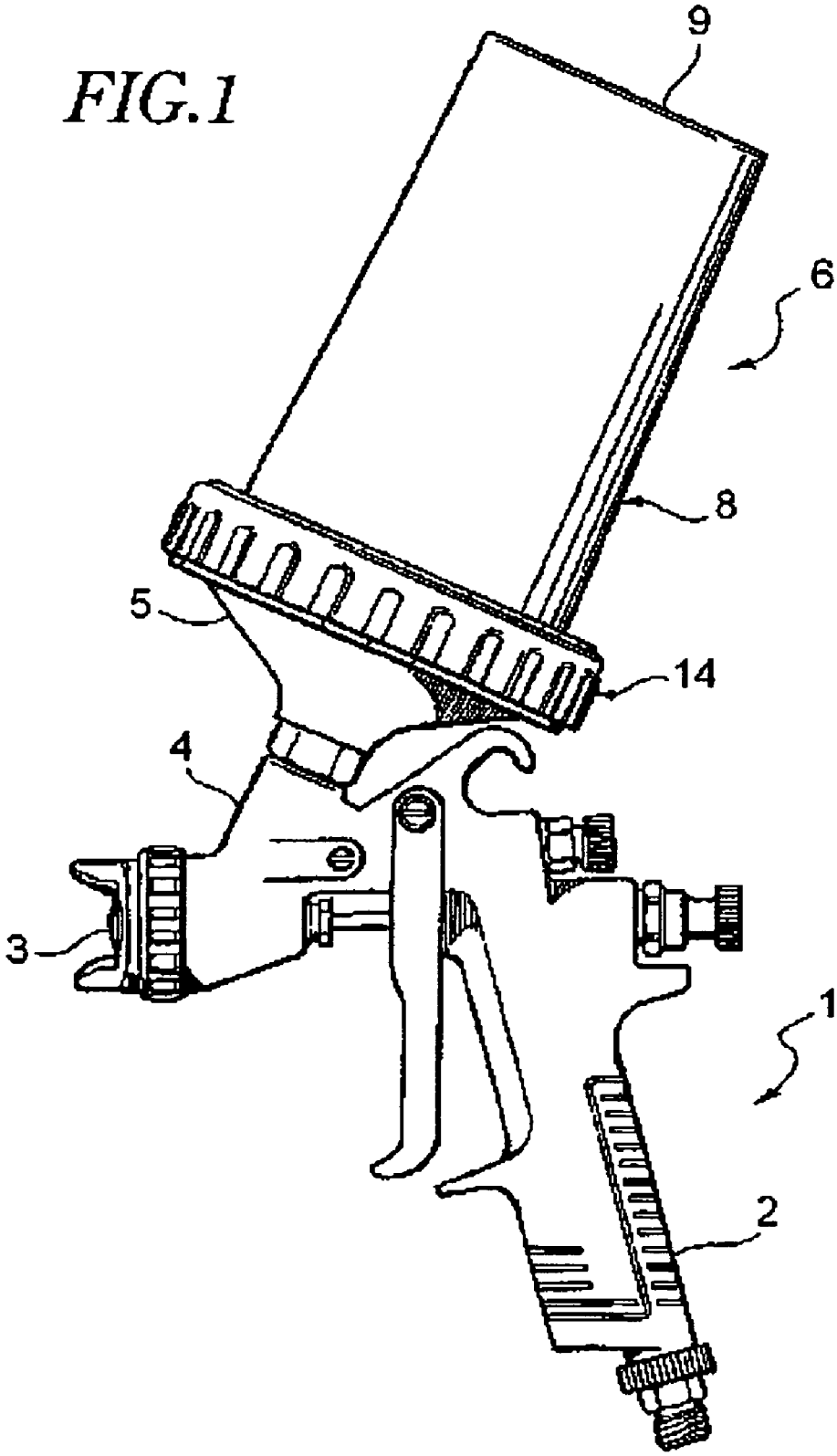
FIG. 1 is a schematic side elevation of a spray gun provided with a cup according to the invention.

Referring initially to FIG. 1, the reference number 1 designates the body of a spray painting gun provided posteriorly with a grip 2 and anteriorly with a nebulising nozzle 3 of a generally conventional type.

In the upper part of the gun 1 is formed a tubular boss 4 communicating with a supply conduit, not visible, connected in known fashion to the atomiser nozzle 3.

The boss 4 is adapted for the application of a generally conical, or funnel shaped element 5, which defines the lid of a disposable cup 6 containing the substance to be sprayed by means of the gun 1.

The funnel element 5, made of metal or plastic material, is independent of the disposable cup 6 in the sense that it constitutes and integrated part of the body of the gun: it can be joined to the boss permanently, i.e. in fixed fashion, or in removable fashion. In the case of the illustrated example, the coupling of the funnel element 5 to the boss 4 is achieved by means of a threaded connection including, in the manner shown in FIGS. 2 and 3, an externally threaded tubular outflow fitting 7 axially projecting from the funnel element 5 and screwed in a corresponding inner thread, not shown, of the tubular boss 4. It should be noted that said coupling could also be accomplished differently, for instance with a bayonet coupling or the like, and as stated also in permanent, i.e. not removable, fashion. A solution can also be envisioned in which the funnel element 5 is integrally formed in a single piece with the body of the gun 1.

Figure 2:
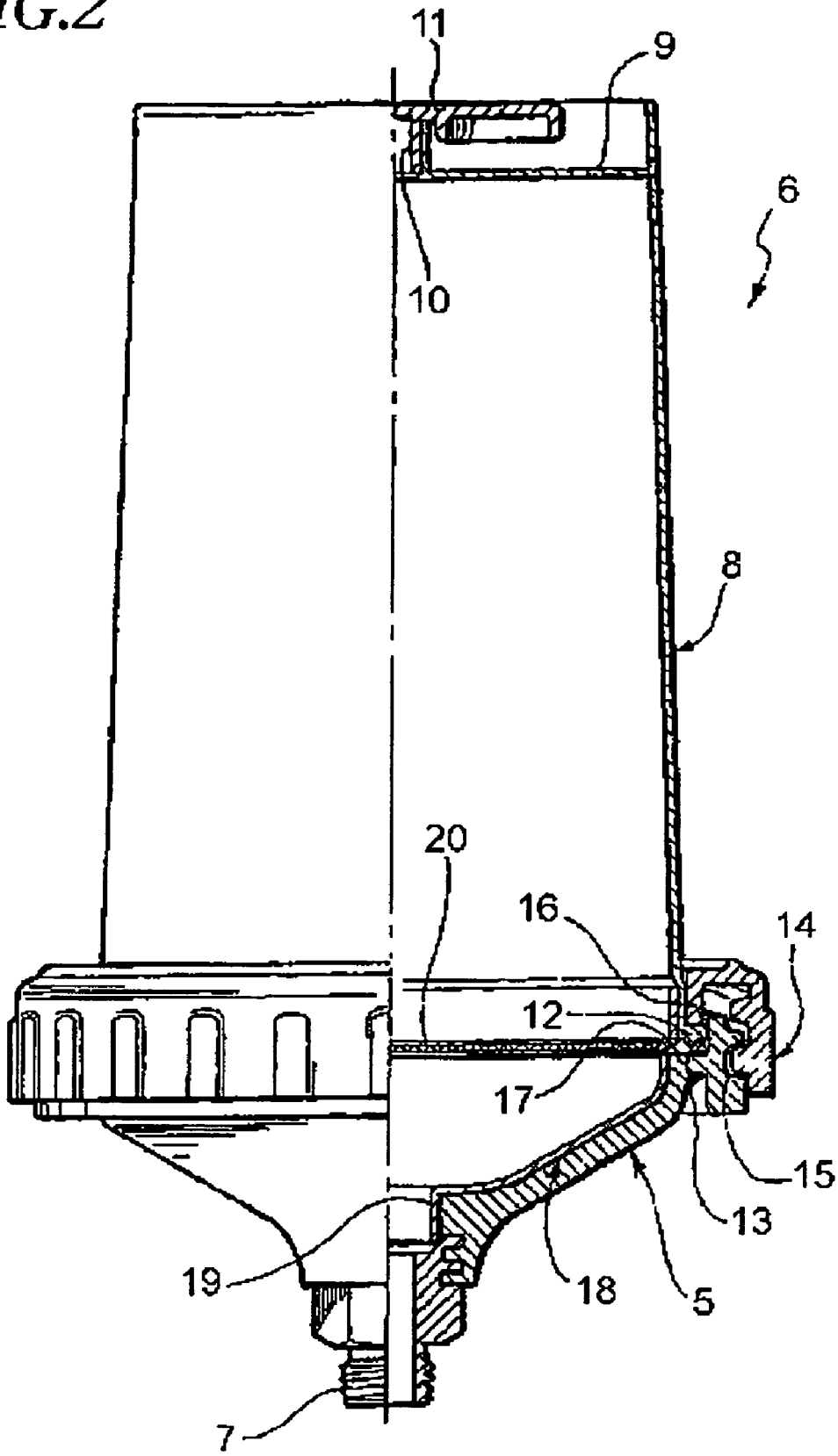
FIG. 2 is a partially sectioned and enlarged elevation view of the cup.
Figure 3:
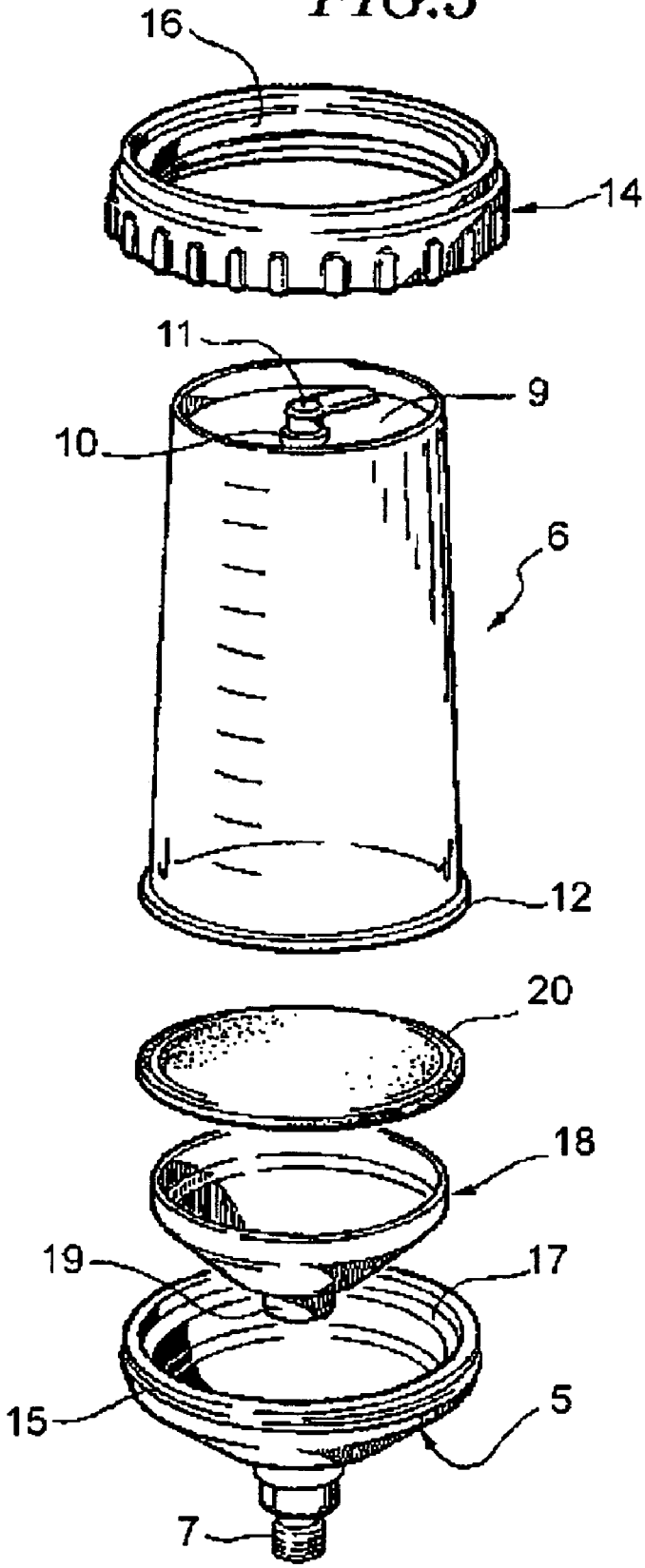
FIG. 3 is an exploded perspective view, in reduced scale, of the cup.

Referring now in greater detail to FIGS. 2 and 3, the disposable cup 6 comprises a glass-shaped container 8 normally made of moulded plastic material, having cylindrical or more advantageously cone frustum shape in order to allow its stacking by mutual insertion with identical containers.

The bottom wall of the glass shaped container 8, designated by the number 9, is provided with an aeration valve generally designated by the number 10, whose opening and closing can be controlled by means of a shutter 11 which can be manually actuated in rotation. For the spraying, by the gun 1, of the substance contained in the disposable cup 6, the aerating valve will be placed in the open position, in order to place the glass shaped container 8 in communication with the environment at atmospheric pressure.

The end of the glass shaped container 8 opposite the bottom wall 9 is open and it has an outer radial flange 12 formed integrally with a circumferential sealing lip 13 projecting axially.

The annular flange 12 with the sealing lip 13 is hermetically connected in removable fashion to the funnel element 5 by means of an internally threaded ring nut 14 screwed onto an outer thread 15 of said funnel element 5. The ring nut 14 advantageously has an internal axial annular appendage 16 adapted to press dorsally the annular flange 12 of the glass-shaped container 8 against an internal annular abutment surface 17 of the funnel element 5. This assures the connection with total hermetic seal without risks of leaks between the glass-shaped container 8 and the funnel element 5.

According to a fundamental characteristic of the invention, the disposable cup 6 further comprises a lining element 18 whose shape is complementary to that of the funnel element 5 and which is inserted in removable fashion within it between the annular flange 12 of the glass shaped element 8 and the outflow fitting 7. The lining element 18, which conveniently is also made of moulded plastic material, is preferably disposable and advantageously it has an axial tubular appendage 19 which can extend at least partially within the tubular fitting 7.

The lining element 18 is axially locked within the funnel element 5 by means of the same ring nut 14 for the removable union of the glass 8. In the case of the illustrated example, the locking is accomplished by the interposition of a filtering disk 20 whose circumferential edge is closed between the sealing lip 13 of the annular flange 12 of the glass 8 and the annular abutment surface 17 of the funnel element 5. It should, however, be observed that the filtering disk 20 is optional: in its absence, or with a differently shaped filtering element engaged for example within the tubular fitting 7, the lining element 18 may be provided with an external annular flange interposed between the lip 13 and the abutment surface 17. The lining element 18 may also be formed in a single piece with the glass shaped container 8.

The assembly and disassembly of the disposable cup 6 will be readily apparent from the above description: the removal of the glass 8 and of the lining element 18 for their possible replacement can be rapidly and easily performed by effect of the simple unscrewing of the ring nut 14 relative to the funnel element 5.

According to a variation, not shown in the drawings, the glass container 8 of the disposable cup 6 can be subdivided internally, by means of an integral axial baffle, into two separate chambers, each destined to contain a respective different substance to be sprayed. In this case, the lining element 18 may also be formed with a pair of separate passages able to place in communication the two chambers of the glass shaped element 8 with the outflow fitting 7. To said passages may conveniently be associated respective manual shut off valves to open-close and regulate the flow of the two substances contained in the disposable cup 6 towards the supply conduit of the body 1 of the gun. The two passages may also have different sections, for instance with ratios variable between 1:1 and 1:5, according to the characteristics of the two substance.

Naturally, the construction details and the embodiments may vary widely with respect to what is described and illustrated herein, without thereby departing from the scope of the present invention as defined in the claims that follow.

The invention claimed is:

1. A manual spray gun comprising:

a body having a conduit for supplying a substance to be sprayed: and a cup comprising a disposable container opening at an end, a conical lid having an axial outflow fitting connected to said conduit of the body, and a ring nut for making removably sealed connection between the end of the container and said lid, said lid being independent of the cup and constituting part of the body, said cup further comprising a lining element whose shape is complementary to that of said lid, said lining element being positioned removably between the end of the container and said outflow fitting.

2. A gun as claimed in claim 1, wherein said lining element has a tubular axial appendage extending at least partially into said tubular fitting of the lid.

3. A gun as claimed in claim 1, wherein said lining element is locked axially relative to said lid by means of said connecting ring nut.

4. A gun as claimed in claim 1, wherein said lining element is disposable.

5. A gun as claimed in claim 1, in which said container disposable is made of moulded plastic material, wherein said lining element is also made of moulded plastic material and is formed in a single piece with said container disposable.

6. A gun as claimed in claim 1, wherein it further comprise a filtering disk axially interposed between said container and said lid and through which said lining element is locked axially by means of said ring nut.

7. A gun as claimed in claim 1, wherein said container has a bottom wall provided with an aeration valve which can be opened and closed by means of a rotary shutter.

8. A gun as claimed in claim 1, wherein said container has a cone frustum shape.

9. A gun as claimed in claim 1, wherein said open end of the container has an outer radial flange formed with a circumferential sealing lip projecting axially, and said connecting ring nut has an internal axial annular appendage able to press dorsally said radial flange of the container against an inner annular abutment surface of said lid.

10. A gun as claimed in claim 1, wherein said lid and said lining element have a general funnel shape.

11. A cup for a spray gun, comprising:

a disposable container opening at an end;

a conical lid having an axial flow fitting connectable to a body of the spray gun, said lid being independent from the cup to constitute part of the body of the spray gun;

a ring nut for making removably sealed connection between said end of the container and said lid; and a lining element whose shape is complementary to that of said lid, said lining element being positioned removably within said lid between the end of the container and said outflow fitting.

12. A cup as claimed in claim 11, wherein said lining element has an axial tubular appendage extending at least partially within said tubular fitting of the lid.

13. A cup as claimed in claim 11, wherein said lining element is locked axially relative to said lid by means of said connecting ring nut.

14. A cup as claimed in claim 11, wherein said lining element is disposable.

15. A cup as claimed in claim 11, in which said container disposable is made of moulded plastic material, wherein also said lining element is made of moulded plastic material.

16. A cup as claimed in claim 11, wherein it further comprises a filtering disk axially interposed between said container and said lid and through which said lining element is axially locked by means of said ring nut.

17. A cup as claimed in claim 11, wherein said container has a bottom wall provided with an aeration valve which can be opened and closed by means of a rotary shutter.

18. A cup as claimed in claim 11, wherein said container has a cone frustum shape.

19. A cup as claimed in claim 11, wherein said open end of the container has a radial outer flange formed with a circumferential sealing lip projecting axially, and said connecting ring nut has an internal axial annular appendage able to press dorsally said radial flange of the container against an inner annular abutment surface of said lid.

20. A cup as claimed in claim 11, wherein said lid and said lining element have a general funnel shape.

21. A cup as claimed in claim 11, wherein is adapted to contain two different separate substances to be sprayed.

22. A cup as claimed in claim 11, characterised in that said lining element is formed in a single piece with said disposable container.

* * * * *